US008224231B2

(12) United States Patent
Moore

(10) Patent No.: US 8,224,231 B2
(45) Date of Patent: Jul. 17, 2012

(54) PRINTING SYSTEM AND METHOD

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 1005 days.

(21) Appl. No.: 12/175,001

(22) Filed: Jul. 17, 2008

(65) Prior Publication Data

US 2010/0013138 A1 Jan. 21, 2010

(51) Int. Cl.
*G03G 15/00* (2006.01)

(52) U.S. Cl. ..... 399/407; 399/405; 399/408; 399/409; 399/410

(58) Field of Classification Search ..... 399/82, 399/405, 407–410
See application file for complete search history.

(56) References Cited

U.S. PATENT DOCUMENTS

| | | | | |
|---|---|---|---|---|
| 6,606,466 | B2 * | 8/2003 | Sato | 399/82 |
| 6,741,817 | B2 * | 5/2004 | Seto | 399/75 |
| 2006/0263110 | A1 * | 11/2006 | Sahay | 399/82 |
| 2007/0127942 | A1 * | 6/2007 | Douglas | 399/81 |

OTHER PUBLICATIONS

*Breakthrough quality and productivity*, OcéVarioPrint® 6250, OcéImagistics Inc., 2007, pp. 1-2.

* cited by examiner

*Primary Examiner* — Matthew G Marini
(74) *Attorney, Agent, or Firm* — Fay Sharpe LLP

(57) ABSTRACT

A finishing unit includes a first compiling module and a second compiling module operatively connected in parallel with the first compiling module. Each compiling module includes a finishing head adapted to perform a finishing operation upon a plurality of sheets of media. A printing system includes a sheet media source, a finishing unit operatively spaced from the sheet media source and a marking unit operatively disposed therebetween. A method of performing a print job using such first and second compiling modules is also included.

16 Claims, 5 Drawing Sheets

PRINTING SYSTEM AND METHOD

BACKGROUND

Printing systems of a variety of types and kinds are well known and commonly used in the production of print jobs that include numerous marked or printed sheets of media. Often, these marked or printed sheets of media are grouped or otherwise separated into two or more sets that together form a given print job. In some cases, the individual sets of marked sheets of media are simply grouped together and output as a stack of sets, such as by staggering the alignment of adjacent sets, for example. In other cases, however, the print job will include an instruction to perform one or more finishing operations on each individual set. Examples of such finishing operations can include hole punching and stapling or stitching operations.

One result of including such a finishing instruction for one or more of the sets of a print job is that each set that is to undergo a finishing operation will take some additional amount of processing time for the finishing operation to be completed. In some cases, this additional amount of processing time may result in only a relatively small or otherwise minor increase in the overall production time of the print job. This can be particularly true in cases in which the sets of the print job include a significant number of printed sheets (e.g., twenty or more marked sheets of media). As an example, a set that includes fifty marked sheets of media can be generated on a printing system that operates at an imaging rate of fifty pages per minute in a time period of about sixty seconds. The performance of a finishing operation (e.g., a stapling or stitching operation) may add only two or three seconds to the overall production time, which represents an increase of about 3-5 percent over the sheet production time. In many cases, this additional amount of time may be deemed to be a relatively modest and, thus, acceptable increase in the overall production time for the convenience of producing a set of marked sheets of media that is in a finished condition.

In other situations, however, a print job may be made up of two or more sets that include a relatively small number of marked sheets of media (e.g., two to ten marked sheets of media). In these cases, the seemingly modest increase in time contributed by a finishing operation can result in a substantial increase in the overall production time of a set. As an example, the printing of a set of five marked sheets could be generated on a printing system having an imaging rate of fifty pages per minute in a time period of about six seconds. The performance of a finishing operation on such a set of marked sheets of media could add a further two to three seconds to the overall production time. This additional finishing time can represent an increase of between 30 and 50 percent of the sheet production time. In many cases, this increase may be deemed a substantial and undesirable increase in the overall production time.

Additionally, it is common for the finishing unit of known printing systems to include a compiling device that is incapable of receiving individual sheets of media while a finishing operation is being performed thereby. That is, routing additional sheets of media to a compiling device of known finishing units while a finishing operation is being performed thereby is generally avoided as such an action would undesirably affect or otherwise interfere with a stapling, stitching or other operation that is being performed by the compiling device. As such, known finishing units do not generally receive marked sheets of media for compiling during the period (e.g., two to three seconds) that the finishing operation is being performed.

In some cases, a printing system may include a sheet buffering unit or other such device and marked sheets of media can be advanced into such a unit or device during the period that the finishing operation is being performed. In many other cases, however, such a sheet buffering unit or other device will not be included as part of the printing system. So, the media transport pathway of the printing system may not be able to advance marked sheets of media under such circumstances. One possible option under such operating conditions is to simply pause or otherwise discontinue operation of the other portions of the printing system while the finishing operation is performed. There are, however, numerous disadvantages to operating a printing system in such a manner. Such as, for example, the result that the printing system would be inoperative for a substantial period of time, particularly, during production of sets having a relatively small number of marked sheets of media, as discussed above.

Another characteristic that is common to many known printing systems is that the operation of the media transport pathway extending through the printing system is synchronized with the operation of the one or more marking units thereof. Thus, another option for operating under the above-described conditions is to permit the media transport pathway and marking engine to continue to operate in a substantially continuous manner. However, rather than feeding a continuous stream of individual sheets of media to the one or more marking engines, one or more sheet-sized spaces are selectively provided within in the stream of individual sheets traveling along the media transport pathway. Such spaces are often referred to in the art as "skipped pitches." As a series of one or more skipped pitch approaches an associated marking unit, a corresponding number of one or more imaging cycles is skipped by the marking unit. The printing system typically coordinates the provision of these skipped pitches such that the same reach the finishing unit at approximately the same time that a finishing operation is to be performed. In this manner, the printing system can continue to operation during the period that the finishing operation is being performed.

While the foregoing and other methods of operation may have advantages over other options for operating a printing system, the one or more marking units are, nonetheless, operating at a decreased imaging capacity. And, as discussed above, productivity and output can be particularly decreased for print jobs in which numerous sets to be produced that include only a small number of individual sheets of media.

Accordingly, it is believed desirable to develop a finishing unit, printing system and method of performing a print job that overcome the foregoing and other issues.

BRIEF DESCRIPTION

A printing system in accordance with the subject matter of the present disclosure is provided that includes a sheet media source adapted to dispense individual sheets of media. A finishing unit is operatively spaced from the sheet media source and is adapted to receive individual sheets of media. The finishing unit includes a sheet media inlet, a first compiling module in operative communication with the sheet media inlet, and a second compiling module in operative communication with the sheet media inlet and in parallel relation to the first compiling module. The first and second compiling modules are each adapted to receive a plurality of individual sheets of media that together comprise a set of sheets of media. The first and second compiling modules are also adapted to perform a finishing operation on the plurality of individual sheets of media perform a finished set of sheets of media, and stack a plurality of finished sets of sheets of media.

At least one marking unit is operatively disposed between the sheet media source and the finishing unit. The at least one marking unit is adapted to receive the individual sheets of media from the sheet media source and operative to generate marked sheets of media at a predetermined imaging rate. A control system is in communication with at least the finishing unit and is adapted to route a plurality of marked sheets of media comprising a first set to the first compiling module. The control system is also adapted to execute a finishing operation on the first set of marked sheets of media using the first compiling module while concurrently routing a plurality of marked sheets of media comprising the second set to the second compiling module.

A finishing unit in accordance with the subject matter of the present disclosure is provided for use with an associated printing system having an associated sheet media outlet that is capable of delivering a stream of individual sheets of media. The finishing unit includes a sheet media inlet in operative communication with the associate sheet media outlet and the sheet media inlet is adapted to receive a stream of individual sheets of media from the associated sheet media outlet. A first compiling module is in operative communication with the sheet media inlet such that individual sheets of media can be received therefrom. The first compiling module includes a first alignment surface for at least approximately aligning an edge of a plurality of individual sheets of media. The first compiling module also includes a first finishing head operative to perform a finishing operation on the plurality of individual sheets of media together as a set of sheets of media. The first compiling module further includes a first bottom wall operative to support a plurality of sets of sheets of media. A second compiling module is in operative communication with the sheet media inlet and is in parallel operation with the first compiling module. The second compiling module includes a second alignment surface for at least approximately aligning an edge of a plurality of individual sheets of media. The second compiling module also includes a second finishing head that is operative to secure the plurality of individual sheets of media together as a set of sheets of media. The second compiling module further includes a second bottom wall operative to support a plurality of sets of sheets of media. The finishing unit further includes a sheet diverter disposed in operative communication between the sheet media inlet, the first compiling module and the second compiling module. The sheet diverter is operative to selectively route a first portion of the stream of individual sheets of media received at the sheet media inlet to the first compiling module and to route a second portion of the stream of individual sheets of media to the second compiling module such that the first compiling module can perform a finishing operation on the plurality of sheets of media received thereat while the second portion of the stream of individual sheets of media is concurrently routed to the second compiling module.

A method of performing a print job that includes two or more sets of at least two marked sheets of media is provided in accordance with the subject matter of the present disclosure. The method includes providing a printing system that includes a marking unit and a finishing unit. The marking unit is operative to output marked sheets of media. The finishing unit is adapted to receive the marked sheets of media and includes a first compiling module and a second compiling module that is operatively connected for parallel operation with the first compiling module. The method also includes printing a stream of marked sheets of media comprising the two or more sets of at least two marked sheets of media. The method further includes receiving the stream of marked sheets of media at the finishing unit and routing a first portion of the stream to the first compiling module. The method also includes securing the marked sheets of media from the first portion of the stream together as a first set using the first compiling module while concurrently routing a second portion of the stream to the second compiling module. The method also includes securing the marked sheets of media from the second portion of the stream together as the second set using the second compiling module.

DETAILED DESCRIPTION

As discussed above, it will be appreciated that the subject matter of the present disclosure is broadly applicable for use in association with sheet handling and/or transporting systems of any suitable type, kind, configuration and/or construction. As one example, the subject matter of the present disclosure will be shown and described herein with specific reference to use in association with printing systems. It is to be clearly understood, however, that such use is merely exemplary and is not intended to be limiting.

The terms "print", "printing" and "marking" as used herein are to be broadly interpreted to encompass any action or process involving the production and/or output of sheet media having text, images, graphics and/or other indicia formed thereon by any process, such as inkjet or electrophotographic processes, for example.

The terms "printer" and "printing system" as used herein are to be broadly interpreted to encompass any device, apparatus or system that is capable of performing a "printing" action. Examples of such equipment and/or systems include, without limitation, desktop printers, network printers, standalone copiers, multi-function printer/copier/facsimile devices, high-speed printing/publishing systems and digital printing presses.

Additionally, such exemplary embodiments of equipment, systems and/or processes can utilize sheet media of any suitable size, shape, type, kind, material, quality, weight and/or thickness (e.g., recycled paper, plain paper, bond paper, coated paper, card stock, transparencies and/or other media). Furthermore, such exemplary equipment, systems and/or processes can output indicia on such sheet media using any printing or marking substance, such as liquid ink, solid ink, toner and/or colorant, for example, in monochrome (e.g., black) or one or more colors, or any combination thereof.

Figure 1:
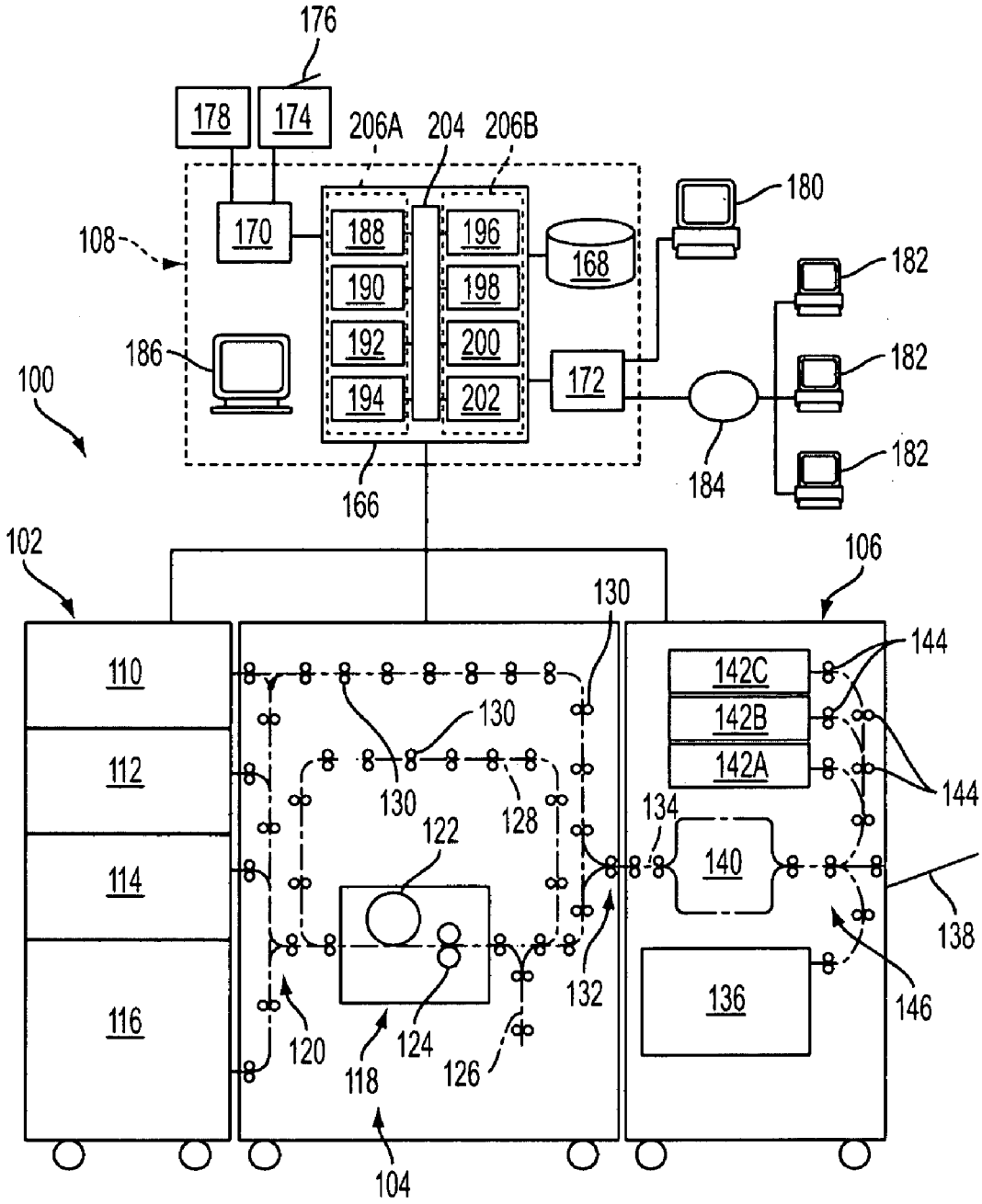
FIG. 1 is a schematic representation of one embodiment of a printing system that includes a plurality of compiling modules operatively connected for parallel operation.

Turning now to the drawings wherein the showings are for the purpose of illustrating exemplary embodiments, and not for limiting the same, FIG. 1 schematically illustrates a printing system 100 that includes a sheet media source 102, a marking system 104 in operative communication with the sheet media source, and a finishing unit 106 or other sheet media receiving system in operative communication with the sheet media source and/or marking system. Printing system 100 also includes a control system 108 in communication with one or more of the sheet media source, the marking system and the finishing unit for selective operation thereof. In the embodiment shown in FIG. 1, control system 108 is in communication with each of these systems. It is to be distinctly understood, however, that aspects of the present disclosure are applicable to a wide variety of types and kinds of printing systems, and that printing system 100 is merely exemplary of one suitable printing system.

Sheet media source 102 is shown in FIG. 1 as including multiple media supply trays 110, 112, 114 and 116, which are suitable for storing bulk quantities of sheet media. Sheet media source 102 can also optionally include a bypass supply tray (not shown) that is capable of handling smaller quantities of sheet media. It will be appreciated that the supply trays are operative to introduce individual sheets of media to a suitable sheet feeding system or mechanism for dispensing the individual sheets. Additionally, it will be appreciated that media supply trays 110-116 are capable of receiving and supporting quantities of sheet media of any one of a variety of different sizes (e.g., letter, legal, A4) and/or orientations (e.g., short-edge first, long-edge first) as well as sheet media of different types, kinds, materials or combinations of material, weights and/or thicknesses.

As shown in FIG. 1, marking system 104 can include one or more marking units 118 (which may also be referred to herein as marking or printing engines) in operative communication with sheet media source 102 by way of a media transport pathway 120. It will be appreciated that the one or more printing engines can be of any suitable type or kind, and that such one or more printing engines will operate in accordance with known marking principles, such as ink jet marking, electrophotographic marking and solid-ink marking, for example, and that monochrome marking (e.g., black), color marking (e.g., cyan, yellow and magenta) or any combination thereof can also be used. As shown in FIG. 1, marking unit 118 is an electrophotographic marking engine that includes a photoreceptor 122, such as a drum or belt type photoreceptor, for example, and a fuser 124 for affixing toner particles deposited on an associated sheet of media by the photoreceptor to form a marked sheet of media. Additionally, it will be appreciated that media transport pathway 120 can be of any suitable configuration and/or arrangement, such as including a sheet inverter 126 and/or a duplex return pathway 128, for example. Furthermore, media transport pathway can also include any suitable type, kind, quantity and/or arrangement of transport elements and/or devices, such as nip transports or pinch rollers 130, for example.

With continued reference to FIG. 1, finishing unit 106 is shown as being in communication with the one or more printing engines of marking system 104 via a sheet media outlet 132 of media transport pathway 120. The finishing unit can be of any suitable type, kind and/or configuration that is capable of performing one or more finishing operations of any type or kind on one group or set of sheets of media while concurrently receiving another group or set of sheets of media for compiling. While a finishing unit in accordance with the subject disclosure may find particular application and use in connection with finishing operations that involve securing a plurality of sheets of media together (e.g., a stapling or stitching operation), it will be appreciated that any suitable type or kind of finishing operation could alternately, or additionally, be performed. For example, a finishing unit in accordance with the subject disclosure could, optionally, be adapted to perform sorting, collating, hole punching, offsetting, binding, folding, separator sheet inserting or any combination of these and/or any other finishing operations.

In the exemplary arrangement shown in FIG. 1, finishing unit 106 includes a sheet media inlet 134 in operative communication with the media transport pathway via sheet media outlet 132 for receiving a stream of marked sheets of media therefrom. Finishing unit 106 can also optionally include a large-capacity stacking device or compiler 136 and/or a direct-discharge outlet tray 138 in communication with sheet media inlet 134 for receiving marked sheets of media therefrom. Finishing unit 106 can also optionally include a sheet buffering arrangement or device 140, such as, for example, for temporarily storing one or more sheets of media prior to delivery to a downstream compiling device or output tray.

Figure 2:
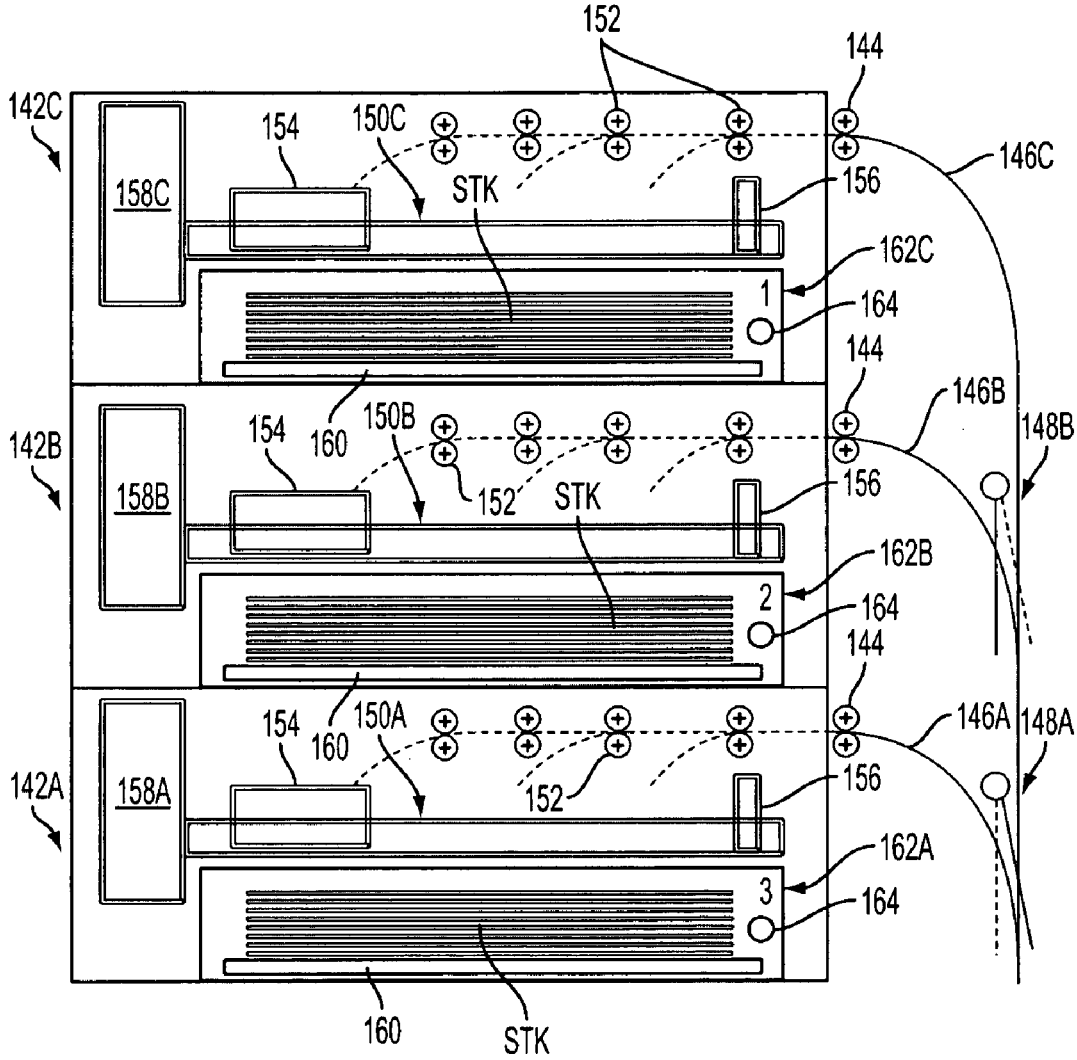
FIG. 2 is a schematic representation of the plurality of compiling modules in FIG. 1.

Furthermore, a finishing unit in accordance with the subject matter of the present disclosure will also include a plurality (e.g., two to fifty) compiling modules that are operatively connected to a sheet media inlet or other sheet media source in parallel relation to one another. As one example, finishing unit 106 is shown in FIGS. 1 and 2 as including three compiling modules 142A-C that are operatively connected with sheet media inlet 134 in parallel relation to one another. As such, a first portion of a continuous stream of marked sheets of media could be routed to first compiling module 142A, a second portion of the continuous stream of marked sheets of media could be routed to second compiling module 142B and a third portion of the stream of marked sheets of media could be routed to third compiling module 142C. Nip transports 144 or other suitable transport elements can be used to transport the portions of the stream of marked sheets of media to the compiling modules, such as along corresponding portions 146A-C of the transport pathway of the finishing unit, which is generally indicated in FIGS. 1 and 2 by reference number 146. Also, sheet diverting elements, such as gates 148A and 148B, for example, can be operatively disposed along transport pathway 146 for selectively routing sheets of media to different devices and/or elements of the finishing unit, such as different ones of compiling modules 142A-C, for example.

The two or more compiling modules of a finishing unit in accordance with the subject matter of the present disclosure are adapted to receive a plurality of individual sheets of media that can together comprise a set of sheets of media. The two or more compiling modules are also adapted to perform a finishing operation on the plurality of individual sheets of media to form a finished set of sheets of media and to stack a plurality of finished sets of sheets of media, such as for later removal by an operator, for example. It will be appreciated that the two or more compiling modules can be of any type, kind, configuration and/or arrangement and can include feature, devices and/or elements of any number, type, kind and/or configuration suitable for operation in at least the above-described manner.

Figure 3:
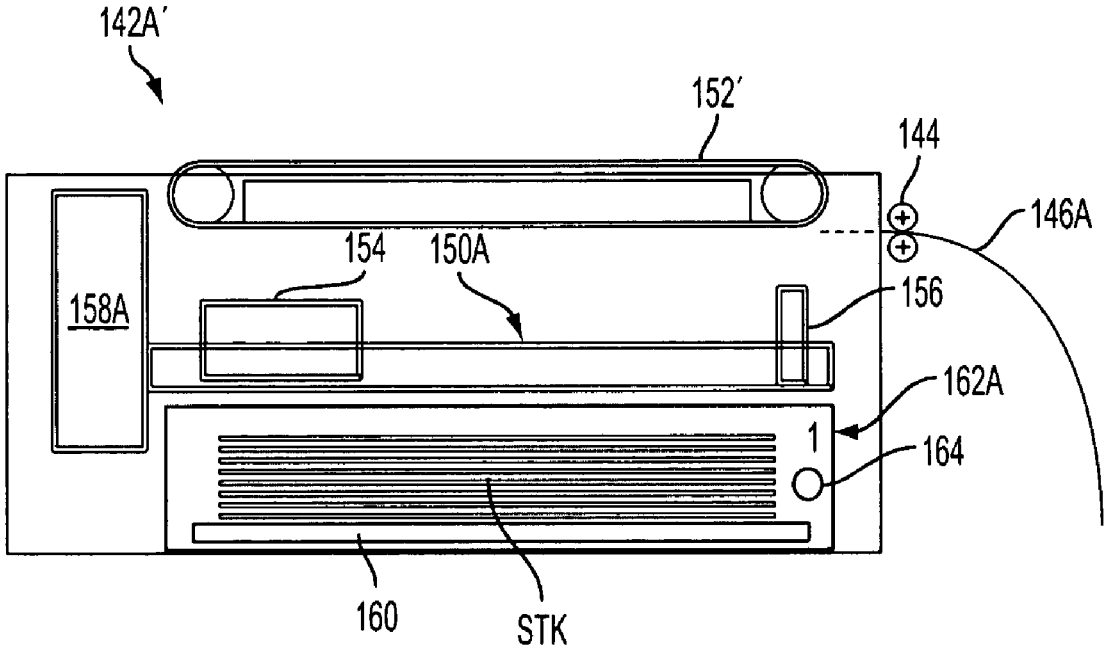
FIG. 3 is a schematic representation of an alternate embodiment of a compiling module in FIGS. 1 and 2.

One exemplary arrangement of a plurality of compiling modules is shown in greater detail in FIG. 2 as compiling modules 142A-C of finishing unit 106. These exemplary compiling modules can each include a compiler tray 150A-C, respectively, for receiving incoming marked (or otherwise individual) sheets of media. Depending upon the size and/or orientation of the incoming sheets of media, one or more different nip transports 152 can be used to feed or otherwise direct the incoming sheets into the compiler tray. Alternately, a vacuum transport belt 152' could be used to transport the incoming sheets of media into a compiling tray 150A, as is shown in FIG. 3 with reference to compiling module 142A'.

Additionally, the exemplary compiling modules are shown in FIG. 2 as including side tampers 154 and trail-edge tampers 156, such as may be operative to at least approximately align one or more edges of adjacent sheets of media with one another. Each of the exemplary compiling modules is also shown as including a finishing head 158A-C that is adapted to perform a finishing operation on one or more marked (or otherwise individual) sheets of media received along and supported on a corresponding compiling tray of the respective compiling module. In the exemplary arrangements shown in FIGS. 2 and 3, the finishing heads are adapted to secure or otherwise attach a group or set of sheets of media together. For example, such finishing heads could be stapling head adapted to utilize staples of a predetermined length or stitching heads adapted to utilize wire or another material of indeterminate length. It will be appreciated, however, that any other finishing heads could alternately, or additionally, be used, as mentioned above.

Compiling modules of a finishing unit in accordance with the subject matter of the present disclosure, such as compiling modules 142A-C of finishing unit 106, for example, preferably include a wall, surface or other area for storing a plurality of finished sets of marked (or otherwise individual) sheets of media. In the exemplary arrangement shown in FIGS. 2 and 3, compiling modules 142A-C each include a stacking support 160 that is shown supporting a stack of finished sets STK. In the exemplary arrangement shown, stacking walls 160 are disposed beneath the corresponding compiling trays of the compiling modules such that finished sets of sheet media can be released by the compiling tray and dropped onto the stacking wall to form stack STK. Though it will be appreciated that any suitable arrangement can alternately be used, optional stacking trays or drawers 162A-C are respectively included in the exemplary compiling modules shown in FIGS. 2 and 3. In one preferred arrangement, a stacking wall 160 is included as a part of each of stacking trays 162A-C. The stacking trays can also include one or more additional walls (not numbered in FIGS. 2 and 3), such as a front wall, a rear wall and one or more side walls, for example.

To permit removal of a plurality of finished sets from the compiling modules, stacking trays 162A-C respectively thereof are preferably displaceable between a closed position in which the bottom wall is disposed beneath the compiling tray for receiving finished sets therefrom and an open or extended position in which the interior of the stacking tray is accessible permitting the removal of a stack of finished sets. The stacking trays can be manually displaceable between the open and closed position. Alternately, the stacking trays can be selectively displaced between the open and closed positions by way of an actuator or other suitable linear motion device. In such case, a user selectable button 164 can optionally be provided, such as on or along the compiling module or stacking tray thereof, for example. Such a user selectable button can operate to eject and/or retract the corresponding stacking tray associated therewith. Optionally, a suitable user-selectable button (not shown) could be included for ejecting and/or retracting two or more of the stacking trays. Additionally, one or more sensors or other position-determining devices can optionally be included that are capable of outputting a signal having a relation to the availability of the compiling module to receive additional sheets of media. As one example, stacking tray sensor (not shown) could be provided that is operative to generate a signal having a relation to the position (i.e., open or closed) of the stacking tray.

Turning, now, to the general operation of a printing system that includes a finishing unit in accordance with the present disclosure, such as printing system 100, for example, sheets of media are fed from a media source (e.g., sheet media source 102) to a printing engine (e.g., marking engine 118 of marking system 104) by way of a media pathway extending therebetween (e.g., media transport pathway 120). Once output by the marking engine or transported directly from the sheet media source, the sheet media, which may be marked or unmarked, is directed to a finishing unit or other sheet media receiving system in accordance with the subject matter of the present disclosure (e.g., finishing unit 106). In some cases, the sheets of media may simply be output from the printing system, such through the use of outlet tray 138, for example. Alternately, the sheets of media could be directed to a stacking or compiling device, such as large-capacity compiler 136, for example, for the performance of one or more compiling operations thereon (e.g., stacking, sorting and/or collating).

As a further alternative, the individual sheets of media could be out output by the marking engine and/or the sheet media source as a stream of sheets of media that comprises two or more sets of at least two sheets of media. Preferably, such a stream of individual sheets of media will be substantially continuous such that each individual sheet is disposed in an immediately adjacent pitch or sheet space within the media transport pathway. As a result, the number of skipped pitches or sheet spaces are minimized or even eliminated from the stream. Individual sheets of media from such a stream are received by the finishing unit, which can include two or more compiling modules (e.g., compiling modules 142A-C) that are disposed within the finishing unit for parallel operation with one another. The two or more compiling modules are preferably adapted to receive individual sheets of media and will also, preferably, include at least one finishing head or other device for performing one or more finishing operations on the individual sheets of media received thereby.

The stream of individual sheets of media that is received at the finishing unit can then be selectively routed to different ones of the two or more compiling modules. In this way, a first portion of a stream of sheets of media, such as may at least partially comprise a first set, for example, can be routed to one compiling module (e.g., one of compiling modules 142A-C) and a second portion of the stream of sheets of media, such as may at least partially comprise a second set, for example, can be routed to another compiling module (e.g., a different one of compiling modules 142A-C). Such an arrangement and method of operation will permit the substantially continuous stream of individual sheets of media to be received by the finishing unit in a substantially continuous manner. That is, without causing interruptions and/or delays in the operation of the media transport pathway and/or the marking system.

Additionally, each compiling module of the finishing unit can perform a finishing operation in an independent manner relative to the other compiling modules that are operatively connected for parallel operation therewith. As such, with further reference to the foregoing example, the first compiling module can perform a finishing operation, such as a stapling or stitching operation, for example, on the first set while the individual sheets of media comprising the second set are being concurrently routed to the second compiling module. The first set can then be released, stacked, ejected or otherwise dispensed from the first compiling module in advance of a third portion of the stream of sheets of media, such as may comprise a third set, for example, being routed thereto for further compiling while a finishing operation is being concurrently performed on the second set by the second compiling action. In this manner, the performance and operation of the compiling modules can be repeated until the print job, which comprises the two or more sets, is complete or the storage capacity of the compiling modules (i.e., the capacity to stack finished sets) has been reached. The sets can then be removed from the compiling modules, such as by an operator, for example, as completed sets or as interim document sets awaiting the performance of additional finishing or compiling operations.

A suitable control system, such as control system 108, for example, can be utilized to operate the foregoing and other systems and/or components of the printing system, such as in the manner discussed above, for example. As shown in FIG. 1, control system 108 includes a controller 166 in communication with sheet media source 102, marking system 104 and finishing unit 106, each in a suitable manner. As one example, media source 102, marking system 104 and finishing unit 106 could be under direct supervision and control by controller 166, as is illustrated in FIG. 1. Alternately, control system 108 could optionally include one or more electronic control units that are respectively associated with the sheet media source, the marking system and the finishing unit. Such one or more ECUs, if provided, can be in communication with the controller and at least partially supervise and/or control the respective components and/or systems with which the ECU or ECUs are associated.

Control system 108 can optionally include a data storage device 168, such as a non-volatile memory or hard drive, for example, that is suitable for storing print jobs, settings, attributes and any other data, values, text, graphics, information and/or content. The data storage device is shown in FIG. 1 as being in direct communication with controller 166, though it will be appreciated that any other suitable arrangement could alternately be used. Additionally, control system 108 can optionally include an input interface 170 and/or a communication interface 172, both of which are shown as being in communication with controller 166.

Either or both of input interface 170 and communication interface 172 can be used to communicate, generate, receive, input or otherwise provide print jobs to the printing system. For example, input interface 170 can be in communication with an optional raster output scanning system 174 suitable for scanning paper documents and transmitting rasterized images of the scanned documents in the form of image data to the controller or another system or component. Scanning system 174 can optionally include an automatic document feeding device 176 or other suitable arrangement for inputting sheet media. As another example, input interface 170 could be in communication with an optional memory device reader 178 adapted to retrieve document files, image files or other data or information from portable memory devices, such as memory cards, for example, and transmit such files, data or information to controller 166 or another system or component.

As a further example, a print job could optionally be transferred or otherwise sent to the printing system through communication interface 172, such as from a standalone computer 180 and/or from a computer workstation or terminal 182, for example, by way of any suitable line of communication, such as through a computer network 184, for example. A print job, however transmitted or received, can be directly communicated to controller 166 for processing or the print job can be stored in a suitable manner, such as within data storage device 168, for example, until recalled for printing.

One or more user interface devices, such as a display, keyboard, pointing device, indicator lamp, associated computing device (e.g., a remotely connected or networked computer) or other input or output device, for example, is provided on printing system 100 and is in communication with controller 166. In one preferred embodiment, a display 186 is provided that outputs graphical programming windows for communication of text, graphics, data, values and/or information to a user or operator. Additionally, the user interface is adapted for user input of text, graphics, data, values and/or information, such as from the keyboard (not shown), pointing device (not shown) or, in one preferred embodiment, touch-screen input on display 186, for example. It will be appreciated, however, that the foregoing user interface arrangement is merely exemplary and that text, graphics, data, values and/or information can be inputted and outputted in any suitable manner.

Control system 108, as is shown in FIG. 1, can optionally include a print job-receiving module 188 that is capable of receiving, processing, storing and/or otherwise transferring data, information, signals and/or communications relating to a print job that has been communicated to printing system 100, such as by way of input interface 170 and/or communication interface 172, for example. As one example, a print job could be received by way of communication interface 172 and include image data, which is represented in FIG. 1 by box 190, representing or otherwise having a relation to the markings to be generated on one or more of sheets of media. Such a print job may also include sheet media data, which is represented in FIG. 1 by box 192, representing or otherwise having a relation to print job characteristics, such as the size and type of sheet media to be used for the print job, the number of sets (e.g., the number of reproductions of a single, multi-sheet document and/or the number of reproductions of different groups of sheets) to be generated and/or the desired finishing operations (e.g., stapling, stitching and/or hole-punching) to be performed, for example. Print job-receiving module 188 is preferably capable of receiving, processing, storing and/or communicating such image and sheet media data to one or more other systems and/or components of printing system 100. Additionally, it will be appreciated that print job-receiving module 188 can utilize any suitable data, values, settings, parameters, inputs, signals, algorithms, routines and/or any other information or content for receiving a print job and storing image and/or sheet media data corresponding or otherwise related thereto.

Control system 108 is also operative to selectively route individual sheets of media received at the finishing unit to a compiling module thereof (e.g., one of compiling modules 142A-C). As such, control system 108 can also optionally include a sheet routing module 194 that is capable of routing two or more sheets of media to a selected or otherwise predetermined compiling module. The two or more sheets of media routed to a selected compiling module may, for example, correspond to or otherwise relate to image data 190, sheet media data 192 and/or any other data and/or information. Additionally, sheet routing module 194 can optionally include determining or otherwise identifying which one of the two or more compiling modules (e.g., compiling modules 142A-C) may be next available for receiving sheets of media. Sheet routing module 194 can also optionally include retrieving, sensing or otherwise obtaining any data or information regarding an operational state of any one or more of the compiling modules for making such a determination. Furthermore, sheet routing module 194 can utilize any suitable data, values, settings, parameters, inputs, signals, algorithms, routines and/or any other information or content for determining or otherwise identifying a compiling module that may be available and/or for selectively routing the individual sheets of media thereto.

Control system 108 is also operative to selectively execute one or more finishing actions on a group of sheets of media received or otherwise compiled at a compiling module, such as one of compiling modules 142A-C, for example. It will be appreciated that the execution of any such one or more finishing operations can be effected, controlled and/or otherwise performed in any suitable manner. For example, control system 108 is shown in FIG. 1 as optionally including a finishing operation module 196 that is capable of energizing, triggering or otherwise causing a finishing head (e.g., one of finishing heads 158A-C) to perform a finishing operation on a group of sheets of media to form a finished set. Again, it will be appreciated that finishing operation module 196 can utilize any suitable data, values, settings, parameters, inputs, signals, algorithms, routines and/or any other information or content for executing a finishing operation on a plurality of sheets of media to form a finished set therefrom.

As discussed above, in some cases, a print job will include a plurality of copies of a single set of marked sheets of media. In such cases, the individual sets will be formed from identically marked sheets of media. Thus, the plurality of sets can be generated without regard to a specific sequence or order. As such, sheets of media corresponding to a given set can simply be routed to any one of the available compiling modules for compilation and finishing. In other cases, however, a print job may include a single copy of a multitude of different sets of marked sheets of media with the different sets being numerically or otherwise ordered with respect to one another. For example, such a print job might request a single complete copy of a document that includes sixty different chapters, with each chapter including two or more marked sheets of media. In such case, it would be desirable to generate (i.e., print, compile and finish) the finished sets of the print job while maintaining the numerical order of the different sets. That is, continuing with the present example, generating the sixty different chapters in a predetermined sequence or order such that each stack of finished sets is in the desired numerical order. In this way, a first portion of the sixty chapters (e.g., Chapters 1-20) could be generated at a first compiling module, a second portion of the sixty chapters (e.g., Chapters 21-40) could be generated at a second compiling module, and a third portion of the sixty chapters (e.g., Chapters 41-60) could be generated at a third compiling module. The three stacks could then be gathered together to form a complete and ordered print job of Chapters 1-60.

Accordingly, control system 108 can also optionally include a print coordinating module 198 adapted to selectively print a stream of marked sheets of media for a print job comprising a plurality of ordered sets of sheets of media such that sequentially ordered sets are generated at different ones of a plurality of compiling modules disposed in parallel operation with one another. Print coordinating module 198 can utilize any suitable data, values, settings, parameters, inputs, signals, algorithms, routines and/or any other information or content for generating the stream of marked sheets of media. For example, control system 108 can include print coordinating data and/or values, which are collectively represented in FIG. 1 by box 200, that are utilized by print coordinating module 198 to selectively print the stream of marked sheets of media such that the sequentially ordered sets can be generated, as discussed above. As another example, control system 108 could include one or more algorithms or other formulas and/or calculations, which are represented in FIG. 1 by box 202, for use in determining or otherwise identifying sets of marked sheets of media for printing and/or for determining the sequence or order for printing the same.

A control system, such as control system 108, for example, will include a processing device, which can be of any suitable type, kind and/or configuration, such as a microprocessor, for example, for processing data, executing software routines/programs, and other functions relating to the performance and/or operation of the printing system (e.g., printing system 100). Additionally, the control system (e.g., control system 108) will include a storage device or memory, which can be of any suitable type, kind and/or configuration that can be used to store data, values, settings, parameters, inputs, software, algorithms, routines, programs and/or other information or content for any associated use or function, such as use in association with the performance and/or operation of the printing system or communication with a user or operator, for example.

In the embodiment shown in FIG. 1, controller 166 includes a microprocessor 204 and a storage device or memory, which is represented in FIG. 1 by boxes 206A and 206B. In the embodiment shown, modules 188, 194, 196 and 198 are implemented as software stored within memory 206A and 206B. Thus, microprocessor 204 can access memory stores 206A and 206B to retrieve and execute any one or more of such software modules together with any other software that may be optionally stored therein. Additionally, data, values, settings, parameters, inputs, software, algorithms, routines, programs and/or other information or content, such as data 190, 192 and 200 and algorithms 202, for example, can also be retained within memory 206A and 206B for retrieval by microprocessor 204. It will be appreciated that such software routines can be individually executable routines or portions of a software program, such as an operating system, for example. Additionally, it will be appreciated that the control system, including any controller, processing device and/or memory, can take any suitable form, configuration and/or arrangement, and that the embodiments shown and described herein are merely exemplary. Furthermore, it is to be understood, however, that the modules described above in detail can be implemented in any suitable manner, including, without limitation, software implementations, hardware implementations or any combination thereof.

Figure 4:
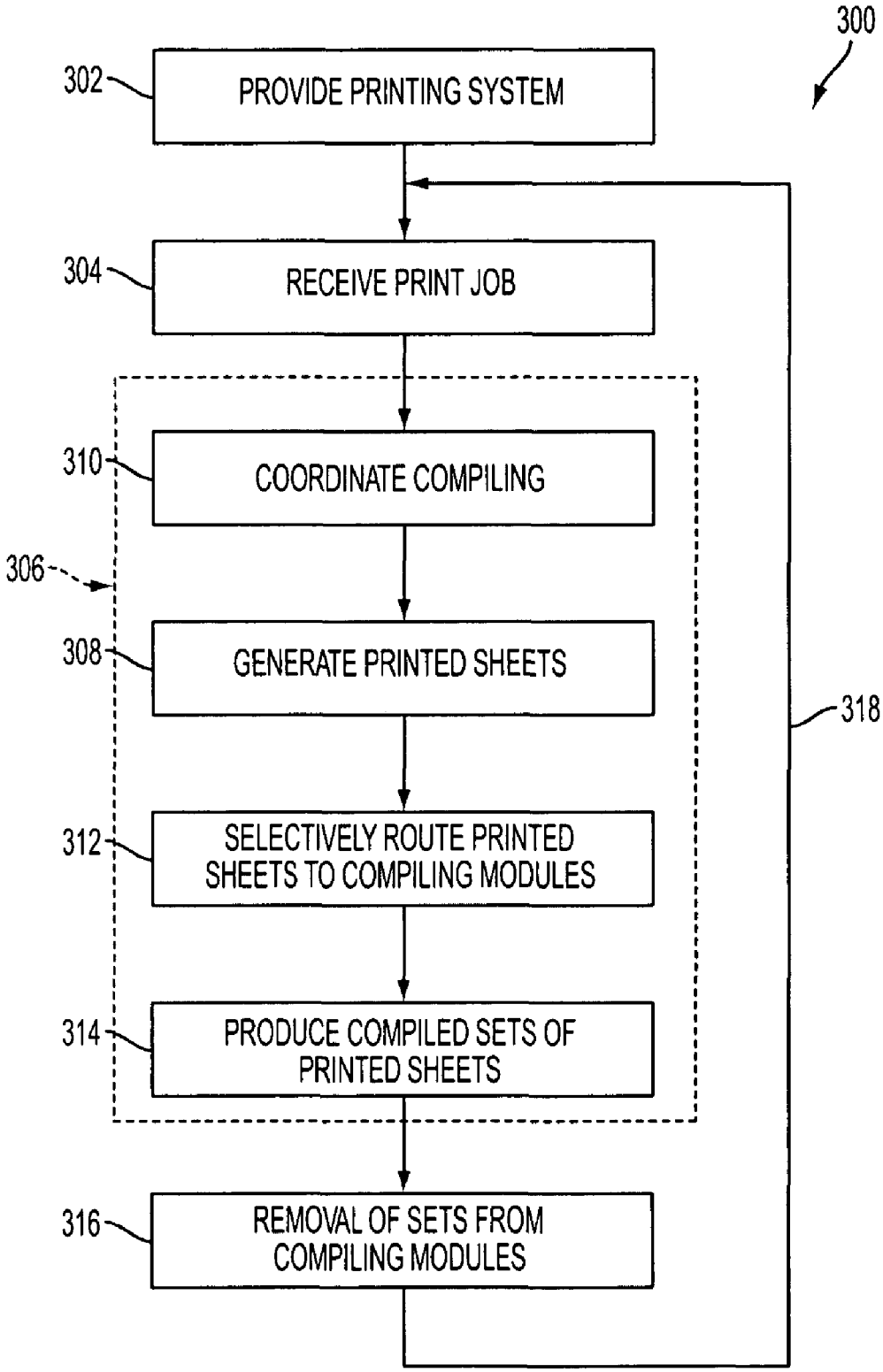
FIG. 4 is a graphical representation of one exemplary method of performing a print job using a plurality of compiling modules.

FIG. 4 illustrates one exemplary method 300 of performing a print job in accordance with the subject matter of the present disclosure. Method 300 includes an action of providing a printing system, such as printing system 100, for example, that includes a finishing unit comprised of two or more compiling modules that are operatively connected for parallel operation with one another, as indicated by box 302 in FIG. 4. It will be appreciated that each of such compiling modules will preferably include a finishing head for performing a finishing action on a set of sheets of media received thereat. One example of such an arrangement has been shown and described herein as compiling modules 142A-C of finishing unit 106, which include finishing heads 158A-C. Method 300 also includes an action of receiving a print job, as indicated by box 304 in FIG. 4, such as by way of input interface 170, communication interface 172 and/or print job receiving module 188, for example.

Method 300 further includes an action of generating a plurality of finished sets of individual sheets of media utilizing a plurality of compiling modules (e.g., compiling modules 142A-C) that are connected for parallel operation with one another such that a finishing operation can be performed on a first plurality of individual sheets of media to form a first finished set while a second plurality of individual sheets of media are being concurrently compiled (i.e., routed to and received at a different compiling module) as a second set. Thereafter, the second set can be formed into a second finished set. This group of actions is collectively represented in FIG. 4 by box 306. It will be appreciated that actions 306 of method 300 can be performed in any suitable manner. As one example, an action of generating printed or marked sheets of media can be performed, as indicated by box 308 in FIG. 4. Optionally, an action of coordinating the printing of the marked sheets of media based, at least in part, on a predetermined compiling order can be performed, as indicated by box 310 in FIG. 4. In either case, an action of selectively routing the marked sheets of media to different ones of the two or more compiling modules is be performed, as indicated by box 312 in FIG. 4, such as has been discussed above, for example.

Method 300 also includes performing a finishing operation on each group of sheets of media received at a compiling module using the finishing head associated therewith to form a finished set of sheets of media, as indicated by box 314 in FIG. 4. Method 300 is also shown as including an action by which the finished sets are removed from the two or more compiling modules, as indicated by box 316 in FIG. 4. It will be appreciated that a method of performing a print job in accordance with the subject matter of the present disclosure, such as method 300, for example, can be repeated any suitable number of times and for any desired number of incoming sheets of media, as indicated by arrow 318. Additionally, it will be appreciated that any other actions, operations and/or steps can optionally be included.

Figure 5:
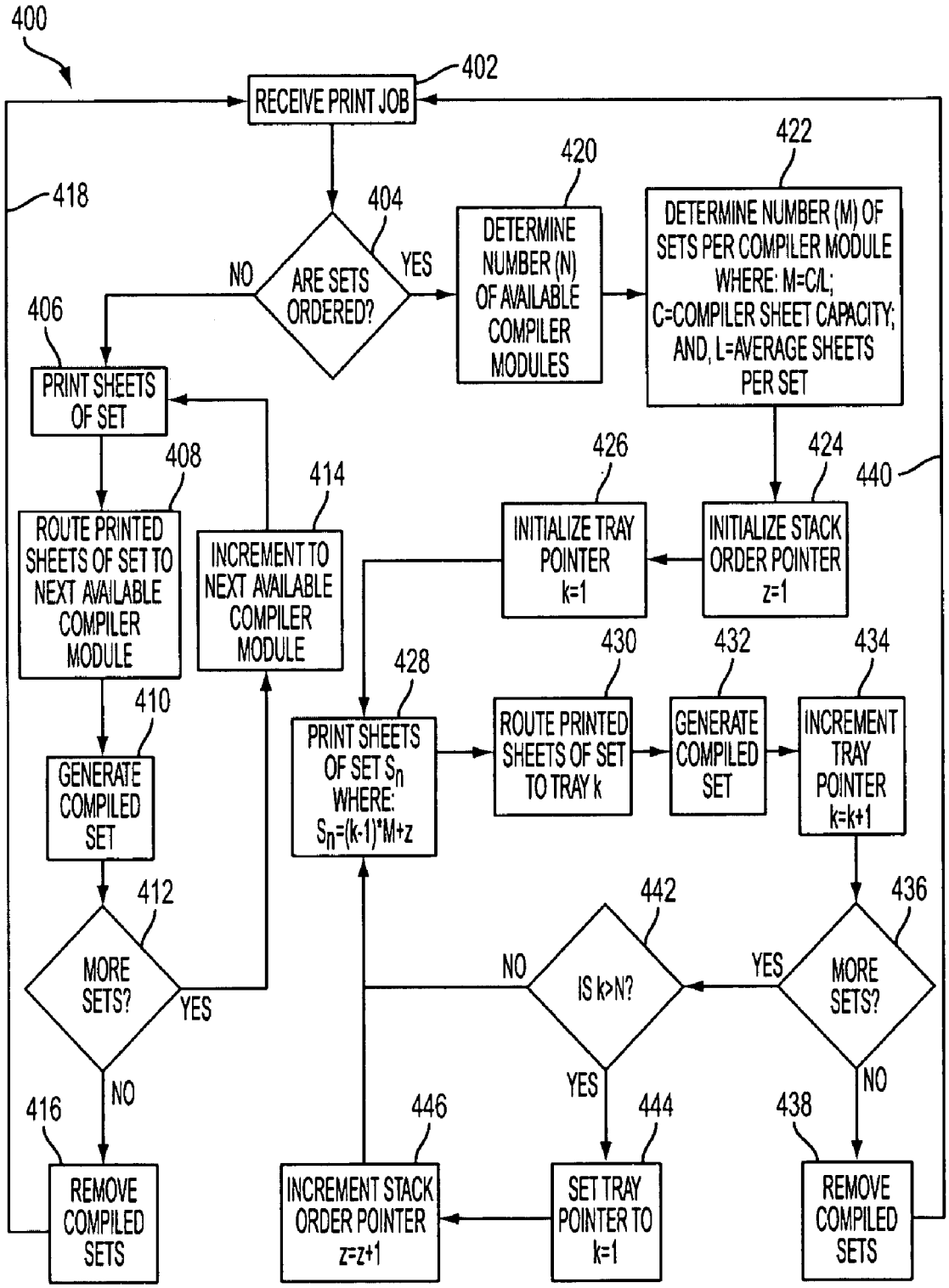
FIG. 5 is a graphical representation of another exemplary method of performing a print job using a plurality of compiling modules.

Another exemplary method 400 of performing a print job in accordance with the subject matter of the present disclosure is shown in FIG. 5, and includes an action of receiving a printing job comprising at least two sets that each includes two or more individual sheets of media, as indicated by box 402 in FIG. 5. Method 400 also include making a determination as to whether the print job includes numerically, sequentially or otherwise ordered sets to be printed, as indicated by decision box 404. It will be appreciated that such a determination can be made in any suitable manner, such as by utilizing print job-receiving module 188 and/or print coordinating module 198, for example.

Upon making a NO determination at decision box 404, an action of printing or otherwise generating marked sheets of media corresponding to a set that is to be compiled is performed, as indicated by box 406 in FIG. 5. It will be appreciated that such an action can be performed in any suitable manner, such as by utilizing print coordinating module 198, for example. An action of routing the marked sheets of media, which correspond to the identified or otherwise selected set, to a compiling module that has been determined to be available for receiving marked sheets of media is performed, as indicated by box 408. It will be appreciated that such an action can be performed in any suitable manner, such as by utilizing sheet routing module 194, for example. Method 400 then includes generating a finished set of marked sheets of media by performing a finishing operation on the marked sheets of media received at the compiling module using the finishing head thereof, as indicated by box 410. It will be appreciated that such an action can be performed in any suitable manner, such as by utilizing finishing operation module 196, for example. A determination is then be made as to whether additional finished sets of the print job remain to be generated, as is indicated by decision box 412. Upon reaching a YES determination, method 400 can include determining or otherwise identifying another compiling module to which marked sheets of media can be routed, as indicated by box 414, and repeating actions 406-412 for at least another set. Upon reaching a NO determination, method 400 permits a user or operator to remove the compiled sets from the two or more compiling modules, as indicated by box 416. Method 400 then awaits the receipt of another print job, as indicated by arrow 418.

If, however, the print job received at box 402 does include numerically, sequentially or otherwise ordered sets, then a YES determination is made at decision box 404. Thereafter, one or more preliminary determinations may be made by control system 108 or any portion thereof. For example, method 400 indicates that the number of available compiler modules (N) can be determined, as indicated by box 420. Additionally, method 400 indicates that the number of sets (M) per compiler module can be determined, as indicate by box 422. The number of sets (M) per compiler module can be determined in any suitable manner, such as, for example, by using the relation M=C/L, where C equals the sheet capacity of the compiling modules and L equals the average number of sheets per set. As one example, such a determination could be made using print coordinating module 198, print coordinating algorithms 200 and/or print coordinating data 202. Additionally, method 400 is shown as including actions to initialize a stack order pointer (z) to a value of 1 and to initialize a tray pointer (k) to a value of 1, as indicated by boxes 424 and 426, respectively. Again, print coordinating module 198, print coordinating algorithms 200 and/or print coordinating data 202 could be used to initialize and store such values.

Method 400 then reaches an action of identifying a set of the print job for which the corresponding marked sheets of media should be generated and then printing the marked sheets so identified, as indicated by box 428. It will be appreciated that such a determination can be made in any suitable manner. As one example, a set ($S_n$) to be generated can be identified using the relation $S_n=(k-1)*M+z$, where k equals the current value of the tray pointer, M equals the number of sets per compiling module, and z equals the current value of the stack order pointer. As one example, such an action could be performed using print coordinating module 198, print coordinating algorithms 200 and/or print coordinating data 202. Once set $S_n$ has been identified and printed in action 428, method 400 includes routing the marked sheets of media to the compiling module corresponding to tray pointer k, as indicated by box 430 in FIG. 5. As one example, such a routing action could be performed using sheet routing module 194. Once all of the individual sheets of media comprising set $S_n$, have been received at the compiling module corresponding to tray pointer k, a finishing operation can be performed to generate a finished set, as indicated by box 432. As one example, such a finishing operation could be executed or otherwise controlled by finishing operation module 196.

Method 400 then includes incrementing tray pointer k according to the relation k=k+1, as is indicted by box 434 in FIG. 5. Such an incrementing action could be performed using print coordinating module 198, print coordinating algorithms 200 and/or print coordinating data 202, for example. Method 400 then indicates that an inquiry is made at decision box 436 as to whether additional finished sets of the print job remain to be generated. Upon reaching a NO determination, the compiled sets can be removed from the two or more compiling modules, as indicated by box 438, such as by a user or operator for example. Method 400 then awaits the receipt of another print job, as indicated by arrow 440.

Upon reaching a YES determination at box 436, however, a further inquiry is made in method 400 as to whether the current value of tray pointer k is greater than the number of available compiler modules (N), as indicated by decision box 442. Upon making a NO determination, method 400 proceeds to identify a set of the print job for which the corresponding marked sheets of media should be generated and printed, as indicated in box 428. As discussed above, the set ($S_n$) to be generated can be identified using the relation of $S_n=(k-1)*M+z$, where k equals the current value of the tray pointer, M equals the number of sets per compiling module, and z equals the current value of the stack order pointer.

Method 400 then proceeds to repeat actions 430-434 until a NO determination is made at action 436. If, however, it is determined that the current value of tray pointer k is greater than the number of available compiler modules (N), a YES determination is made at box 442. Method 400 then proceeds to reset tray pointer k to a value of 1 and to increment stack order pointer z according to the relation z=z+1, as indicated by boxes 444 and 446, respectively. Thereafter, method 400 proceeds to repeat actions 428-434 until a NO determination is made at decision box 436, as discussed above.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a sheet media source adapted to dispense individual sheets of media;

a finishing unit operatively spaced from said sheet media source and adapted to receive individual sheets of media, said finishing unit including a sheet media inlet, a first compiling module in operative communication with said sheet media inlet, and a second compiling module in operative communication with said sheet media inlet, the second compiling module in parallel relation to said first compiling module, said first and second compiling modules each adapted to:

a) receive a plurality of individual sheets of media that together comprise a set of sheets of media;

b) perform a finishing operation on said plurality of individual sheets of media to form a finished set of sheets of media; and, c) stack a plurality of finished sets of sheets of media;

at least one marking unit operatively disposed between said sheet media source and said finishing unit, said at least one marking unit adapted to receive said individual sheets of media from said sheet media source and operative to generate a continuous stream of marked sheets of media at a predetermined imaging rate associated with a consistent sequence of pitches; and, a control system in communication with at least said finishing unit, the control system configured to execute a method of performing a print job including finishing two or more sets of at least two marked sheets of media per set, the method comprising:

a) the at least one marking unit generating a continuous stream of marked sheets of media at the predetermined imaging rate, the continuous stream of marked sheets of media including the two or more sets of at least two marked sheets of media;

b) routing in marking sequence the continuous stream of marked sheets of media to the finishing module at substantially the predetermined imaging rate or greater;

c) the finishing module, selectively routing marked sheets associated with a first set to the first compiling module and routing marked sheets associated with a second set to the second compiling module, whereby a sheet processing rate associated with the parallel combination of the first compiling module and second compiling module is substantially equal to the predetermined imaging rate or greater, and the first compiling module stacks the first set in a first stack operatively associated with the first compiling module, and the second compiling module stacks the second set in a second stack operatively associated with the second operating module;

d) performing a finishing operation upon the first set using the first compiling module, while concurrently continuing to route media sheets associated with the second set to the second compiling module at a processing rate substantially equal to the predetermined imaging rate or greater; and e) performing a finishing operation upon the second set using the second compiling module.

2. A printing system according to claim 1, wherein the print job is comprised of a plurality of sequentially ordered sets, and said control system includes a print coordinating module adapted to:

selectively generate marked sheets of media corresponding to different ones of said sequentially ordered sets using said at least one marking unit; and, selectively route said marked sheets of media to said first and second compiling modules such that a first stack of finished sets from said first compiling module corresponds to a first sequentially ordered portion of said plurality of sequentially ordered sets and a second stack of finished sets from said second compiling module correspond to a second sequentially ordered portion of said plurality of sequentially ordered sets.

3. The printing system according to claim 2, wherein step b) includes:

determining a quantity of available compiling modules (N); and determining a quantity (M) of sequentially ordered sets to be complied at each available compiling module.

4. The printing system according to claim 3, wherein determining a quantity (M) of sequentially ordered sets to be compiled at each compiling module includes using a relationship:

$$M=C/L$$

where: C=a predetermined sheet capacity of a compiling module.

5. The printing system according to claim 4, wherein step b) includes:

identifying a sequentially ordered set ($S_n$) for printing using a relationship:

$$S_n=(k-1)*M+z$$

where: k=a compiling module pointer having a value of from 1 to N z=an incremental counter;

printing a stream of marked sheets of media corresponding to said sequentially ordered set ($S_n$);

routing said sequentially ordered set ($S_n$) to a compiling module corresponding to said compiling module pointer (k); and, performing a finishing operation upon said marked sheets of media together to form said sequentially ordered set ($S_n$) using said compiling module corresponding to said compiling module pointer (k).

6. The printing system according to claim 5, wherein identifying a sequentially ordered set ($S_n$) for printing includes:

setting said incremental counter (z) to an initial value of 1 and setting said tray pointer (k) to an initial value of 1 prior to identifying said sequentially ordered set ($S_n$).

7. The printing system according to claim 5, wherein identifying a sequentially ordered set ($S_n$) for printing includes:

incrementing said compiling module pointer (k) according to a relationship k=k+1; and, determining whether said compiling module pointer (k) is greater than said quantity of available compiling modules (N).

8. The printing system according to claim 7, wherein identifying a sequentially ordered set ($S_n$) for printing includes:

upon determining that said compiling module pointer (k) is one of less than and equal to said quantity of available compiling modules (N), identifying another sequentially ordered set ($S_n$) for printing using a relationship:

$$S_n=(k-1)*M+Z.$$

9. The printing system according to claim 5, wherein identifying a sequentially ordered set ($S_n$) for printing includes:

upon determining that said compiling module pointer (k) is greater than said quantity of available compiling modules (N), setting said compiling module pointer (k) to a value of 1 and incrementing said incremental counter (z) according to a relationship z=z+1; and, identifying another sequentially ordered set ($S_n$) for printing using a relationship:

$$S_n=(k-1)*M+z.$$

10. A printing system according to claim 1 further comprising a media transport pathway operatively connecting said sheet media source, said at least one marking unit and said sheet media inlet of said finishing unit;

said control system being adapted to operate said media transport pathway substantially synchronously with said at least one marking unit such that the continuous stream of marked sheets of media comprising said first and second sets can be generated by said at least one marking unit at said predetermined imaging rate and transported from said at least one marking unit by said media transport pathway at said predetermined imaging rate; and, said first and second compiling modules cooperatively receiving said continuous stream of marked sheets of media from said media transport pathway such that said media transport pathway and said at least one marking unit can operate continuously at said predetermined imaging rate to generate said continuous stream of marked sheets of media comprising said first and second sets.

11. A printing system according to claim 1, wherein said control system is adapted to:

execute a finishing operation on said plurality of marked sheets of media comprising said second set using said second compiling module while concurrently routing a plurality of marked sheets of media comprising a third set to said first compiling module.

12. A printing system according to claim 1, wherein said finishing unit includes a third compiling module in operative communication with said sheet media inlet and in parallel relation to said first and second compiling modules, said third compiling unit adapted to:

a) receive a plurality of individual sheets of media that together comprise a set of sheets of media;

b) perform a finishing operation on said plurality of individual sheets of media to form a finished set of sheets of media; and, c) stack a plurality of finished sets of sheets of media.

13. A printing system according to claim 1 further comprising a sheet media diverter in operative communication with said control system and operatively disposed between said first and second compiling modules such that marked sheets of media can be selectively routed to said first and second compiling modules.

14. A printing system according to claim 13, wherein said sheet media diverter is a gate that is selectively displaceable between a first position operative to direct sheets of media toward said first compiling module and a second position operative to direct sheets of media toward said second compiling module.

15. A printing system according to claim 13, wherein said control system includes a sheet routing module operative to selectively control said sheet media diverter and thereby route said pluralities of marked sheets of media to said first and second compiling modules.

16. A printing system according to claim 1, wherein said at least one marking unit includes one of an electrophotographic marking engine, an ink-jet marking engine and a solid-ink marking engine.

* * * * *